US009229428B2

(12) United States Patent
Maeda

(10) Patent No.: US 9,229,428 B2
(45) Date of Patent: Jan. 5, 2016

(54) IMAGE FORMING APPARATUS CAPABLE OF RECEIVING DIFFERENT CARTRIDGES

(71) Applicant: CANON KABUSHIKI KAISHA, Tokyo (JP)

(72) Inventor: Masanori Maeda, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/159,716

(22) Filed: Jan. 21, 2014

(65) Prior Publication Data

US 2014/0205303 A1 Jul. 24, 2014

(30) Foreign Application Priority Data

Jan. 18, 2013 (JP) ..... 2013-007373

(51) Int. Cl.
*G03G 21/20* (2006.01)
*G03G 21/18* (2006.01)

(52) U.S. Cl.
CPC ..... *G03G 21/206* (2013.01); *G03G 21/1842* (2013.01)

(58) Field of Classification Search
CPC ..... G03G 21/16; G03G 21/20; G03G 21/206; G03G 2/18421
See application file for complete search history.

(56) References Cited

U.S. PATENT DOCUMENTS 4,462,677 A * 7/1984 Onoda ..... 399/114
4,540,268 A * 9/1985 Toyono et al. ..... 399/93
5,341,196 A * 8/1994 Hodoshima et al. ..... 399/13
5,878,304 A * 3/1999 Watanabe et al. ..... 399/92
6,141,512 A * 10/2000 Nagano et al. ..... 399/92
6,909,864 B2 * 6/2005 Komatsubara ..... 399/92
7,012,390 B1 * 3/2006 Able et al. ..... 318/268
7,469,112 B2 * 12/2008 Yuasa ..... 399/92
2005/0078976 A1 * 4/2005 Deguchi et al. ..... 399/92
2006/0104657 A1 * 5/2006 Mori ..... 399/92
2006/0117771 A1 * 6/2006 Fujimori et al. ..... 62/176.1
2006/0204271 A1 * 9/2006 Tai et al. ..... 399/92
2008/0063425 A1 * 3/2008 Idehara et al. ..... 399/93
2008/0279580 A1 * 11/2008 Goda ..... 399/92

(Continued)

FOREIGN PATENT DOCUMENTS

JP 10-003249 A 1/1998
JP 2004-101672 A 4/2004

(Continued)

OTHER PUBLICATIONS

Machine translation of JP 2012014110 A.*

(Continued)

*Primary Examiner* — David Bolduc
(74) *Attorney, Agent, or Firm* — Fitzpatrick, Cella, Harper & Scinto

(57) ABSTRACT

An image forming apparatus includes a mounting portion to which one of a plurality of kinds of cartridges having different configurations is mountable, a fan device for cooling the cartridges mounted to the mounting portion with air flow provided thereby, and a changing device for changing a state of the air flow in accordance with the configuration of the cartridge mounted to the mounting portion. The changing device includes a contact member contactable to the cartridge mounted to the mounting portion, and the contact member is displaceable in accordance with a configuration of the mounted cartridge to change the state of air flow.

12 Claims, 12 Drawing Sheets

(56) References Cited

U.S. PATENT DOCUMENTS

| | | | | |
|---|---|---|---|---|
| 2009/0285588 | A1* | 11/2009 | Furuichi et al. | 399/27 |
| 2010/0014885 | A1* | 1/2010 | Domhoff et al. | 399/92 |
| 2012/0093528 | A1* | 4/2012 | Shiori et al. | 399/43 |
| 2012/0107009 | A1* | 5/2012 | Yano | 399/92 |
| 2013/0142538 | A1 | 6/2013 | Miwa et al. | |
| 2013/0243491 | A1* | 9/2013 | Nodera et al. | 399/260 |
| 2013/0287426 | A1* | 10/2013 | Sadamitsu | 399/94 |
| 2014/0140719 | A1* | 5/2014 | Suzuki | 399/92 |

FOREIGN PATENT DOCUMENTS

| | | | | |
|---|---|---|---|---|
| JP | 2005-204192 | A | | 7/2005 |
| JP | 2006138910 | A | * | 6/2006 |
| JP | 2007-057964 | A | | 3/2007 |
| JP | 2009-294592 | A | | 12/2009 |
| JP | 2010-002711 | A | | 1/2010 |
| JP | 2011133659 | A | * | 7/2011 |
| JP | 2011-154316 | A | | 8/2011 |
| JP | 2012014110 | A | * | 1/2012 |
| JP | 2013-047840 | A | | 3/2013 |
| JP | 2013-120235 | A | | 6/2013 |

OTHER PUBLICATIONS

Machine translation of JP 2009294592 A.*

* cited by examiner (a)

(b)

(a)

(b)

IMAGE FORMING APPARATUS CAPABLE OF RECEIVING DIFFERENT CARTRIDGES

FIELD OF THE INVENTION AND RELATED ART

The present invention relates to an image forming apparatus in which a process cartridge is removably mountable.

In an image forming apparatus, a sheet of recording medium is conveyed to the transfer station of the apparatus, which is made up of a transfer roller and a process cartridge. In the transfer station, toner is transferred onto the sheet of recording medium. Then, the sheet of recording medium, on which an unfixed toner is present, is conveyed to the fixation station of the image forming apparatus, which is made up of a fixation roller having a heat source, and a pressure roller. Then, the sheet is conveyed through the fixation station. While the sheet is conveyed through the fixation station, the unfixed toner on the sheet is fixed to the sheet by heat and pressure. Then, the sheet is discharged into the delivery tray of the image forming apparatus.

In recent years, it has come to be eagerly desired to reduce an image forming apparatus in size, and also, to increase in speed. One of the methods to increase an image forming apparatus in speed is to reduce the apparatus in the first-print-out-time, that is, the length of time it takes for the apparatus to output the first print in an image forming operation. From the standpoint of reducing an image forming apparatus in the first-print-out-time, an image forming apparatus is desired to be as short as possible in the length of its recording medium conveyance passage.

However, reducing an image forming apparatus in size reduces the apparatus in volume, which in turn reduces the apparatus in thermal capacity. As the apparatus reduces in thermal capacity, it is easily affected by the activity of the fixing device of the apparatus. That is, the apparatus is likely to be excessively increased in internal temperature by the heat generated by the fixing device.

One of the structural arrangements for cooling the interior of an image forming apparatus is disclosed in Japanese Laid-open Patent Application 2005-204192. According to this patent application, the internal temperature of the image forming apparatus is detected, and the cooling fan is adjusted in air volume in response to the increase in the internal temperature.

A process cartridge for an image forming apparatus has various image processing means, such as toner, a photosensitive member, a toner container, a developing device, a cleaning blade, a cleaning device container, etc. These components have portions which are easily affected by heat. In particular, toner is easily affected by heat. More specifically, as temperature increases beyond a certain level, toner reduces in chargeability, which results in the formation of an unsatisfactory image.

More concretely, as ambient temperature increases beyond a certain level, the waste toner particles recovered by the cleaning blade in a process cartridge melt and agglomerate, and therefore, it is possible that they will not be properly recovered. If the waste toner fails to be properly recovered, it is likely that an unsatisfactory image, more specifically, an image having unwanted black stripes, is formed.

One of the methods for preventing a process cartridge from excessively increasing in temperature is to structure an image forming apparatus so that the cartridge is positioned far enough from the fixation station, which is a heat source, to make it difficult for the heat from the fixation station to reach the cartridge. However, increasing an image forming apparatus in the distance between the cartridge and fixation station requires the apparatus to be increased in overall size, and also, to lengthen the sheet conveyance passage of the apparatus. Thus, it increases the image forming apparatus in the first-print-out-time.

There is disclosed another method for cooling a cartridge in an image forming apparatus, in Japanese Laid-open Patent Application 2004-101672. According to this patent application, air is blown at the cartridge to create airflow through the cartridge so that the cartridge is efficiently cooled.

However, the art disclosed in Japanese Laid-open Patent Application 2005-204192 requires a temperature detecting means. Thus, this art is not desirable from the standpoint of reducing an image forming apparatus in cost and size.

Further, in the case of the image forming apparatus disclosed in Japanese Laid-open Patent Application 2004-101672, air is blown at the cartridge in the apparatus to make the air flow through the cartridge, in order to highly efficiently cool the cartridge. This cooling method, however, is also problematic for the following reason. That is, in a case of an image forming apparatus capable of accommodating two or more types of cartridges, which are different in shape and/or size, it has to be changed in the manner in which air is blown at the cartridge in the apparatus so that the manner in which air is blown at the cartridge matches the shape and/or size of the cartridge. Thus, the art disclosed in Japanese Laid-open Patent Application 2004-101672 also is not satisfactory in the case of an image forming apparatus capable of accommodating two or more types of process cartridges, which are different in shape and/or size.

In particular, in the case of a large process cartridge, the toner therein increases in temperature simply by being stirred. Thus, a method for properly blowing air at a large process cartridge is desired. That is, an image forming apparatus capable of accommodating multiple types of process cartridges, which are different in shape and/or size needs to be structured so that it can be changed in the state of its internal airflow according to the shape and/or size of the cartridge therein.

SUMMARY OF THE INVENTION

Thus, the primary object of the present invention is to provide an image forming apparatus which can be changed in the state of its internal airflow according to the shape and/or size of the cartridge(s) therein, being therefore capable of efficiently preventing the cartridge(s) therein from excessively increasing in temperature, and therefore, remaining excellent in image quality.

According to an aspect of the present invention, there is provided an image forming apparatus comprising a mounting portion to which a plurality of kinds of cartridges having different configurations; a fan device for cooling said cartridges mounted to said mounting portion with air flow provided thereby; and a changing device for changing a state of the air flow in accordance with the configuration of said cartridge mounted to said mounting portion.

Further features of the present invention will become apparent from the following description of exemplary embodiments (with reference to the attached drawings).

BRIEF DESCRIPTION OF THE DRAWINGS

In FIG. 7, (*b*) is a block diagram of the airflow control system of the image forming apparatus in the second embodiment.

In FIG. 8, (*b*) is a block diagram of the airflow control system of the image forming apparatus in the third embodiment.

DESCRIPTION OF THE PREFERRED EMBODIMENTS

Hereafter, the present invention is concretely described with reference to the embodiments of the present invention.

Embodiment 1

To begin with, referring to FIGS. 1-6, the image forming apparatus in the first embodiment of the present invention is described about its structure.

Figure 1:
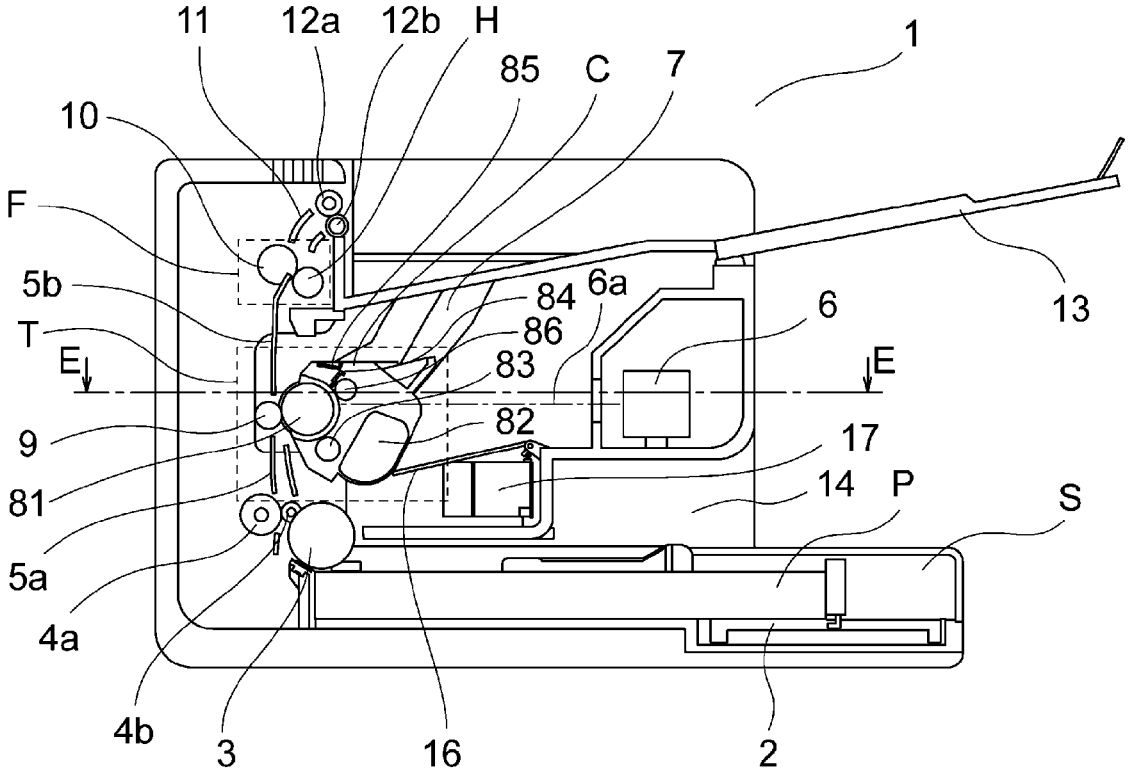
FIG. 1 is a schematic sectional view of the image forming apparatus in the first embodiment of the present invention, and shows the general structure of the apparatus.

FIG. 1 is a sectional view of the image forming apparatus 1 which is in accordance with the present invention. The image forming apparatus 1 in FIG. 1 employs an electrophotographic image forming method, which records an image on the peripheral surface of its photosensitive drum 81 (as an image bearing member) by scanning the peripheral surface of the photosensitive drum 81 with a beam 6*a* of laser light.

Referring to FIG. 1, the image forming apparatus 1 is provided with a sheet feeding/conveying section S (as a sheet feeding/conveying means), which has a sheet feeder tray 2, in which multiple sheets P of recording medium are storable in layers, and a sheet feeder roller 3, which feeds the sheets P in the tray 2, one by one, into the main assembly of the image forming apparatus 1.

The sheet feeder roller 3 feeds each of the sheets P in the tray 2, while separating it from the rest, into the image forming apparatus 1. There are disposed a pair of sheet conveyance rollers 4*a* and 4*b*, on the downstream side of the sheet feeder roller 3 in terms of the recording medium conveyance direction. As each sheet P is fed into the image forming apparatus 1, it is conveyed to the transfer station T (cartridge bay), by the pair of sheet conveyance rollers 4*a* and 4*b*, along a sheet guiding member 5.

A laser scanner 6, which scans the peripheral surface of the photosensitive drum 81 with the beam 6*a* of laser light, is above the sheet feeder tray 2.

The main assembly of the image forming apparatus 1 is structured so that each of two or more types of process cartridges, which are different in shape and/or size, is removably installable into the cartridge chamber of the main assembly, along the cartridge guide 7 of the main assembly.

More specifically, a cartridge C is inserted into the transfer station T (cartridge bay), shown in FIG. 1, along the cartridge guide 7.

The cartridge C is made up of the photosensitive drum 81, a combination of processing means such as a toner container 82, a developing device 83, a cleaning blade 84, a cleaning means container 85, a charge roller 86, etc., and a compact case in which the preceding components are integrally disposed.

The transfer roller 9 is placed in contact with the photosensitive drum 81 of the cartridge C, and transfers the toner image on the peripheral surface of the photosensitive drum 81, onto a sheet P of recording medium. The toner particles on the peripheral surface of the photosensitive drum 81, which were not transferred onto the sheet P, are scraped away, and are recovered into the cleaning means container 85. The cleaning blade 84 is formed of an elastic substance such as silicone rubber.

After being moved past the transfer roller 9, the sheet P is conveyed along the guiding member 5*b*, to a fixing device F (as fixing means), which is in the adjacencies of the downstream end of the guiding member 5*b*. Then, the sheet P is conveyed through the fixing device F. While the sheet P is conveyed through the fixing device F, the unfixed toner image on the sheet P is fixed to the sheet P by heat and pressure.

The fixing device F is made up of a pressure roller 10, which is rotatably supported, and a heater unit which has a heat generating member. The heater unit is kept pressed upon the peripheral surface of the pressure roller 10 with the application of a preset amount of pressure to the heater unit H. The sheet P is conveyed between the pressure roller 10 and heater unit H. While the sheet P is conveyed between the pressure roller 10 and heater unit H, the toner image is fixed to the surface of the sheet P by the heat from the heater unit, and the pressure applied by the pressure roller 10. Hereafter, the sheet P having a fixed toner image may be referred to as a post-recording sheet P.

There are a discharge guide 11, and a pair of discharge rollers 12*a* and 12*b*, on the downstream side, in terms of the post-recording sheet conveyance direction, of the fixation nip which the pressure roller 10 and heater unit forms between them.

After being guided to the pair of discharge rollers 12*a* and 12 by the discharge guide 11, the sheet P is discharged by the pair of discharge rollers 12*a* and 12*b*, into the delivery tray 13, which is at the most downstream end of the sheet conveyance passage of the image forming apparatus 1.

Figure 4:
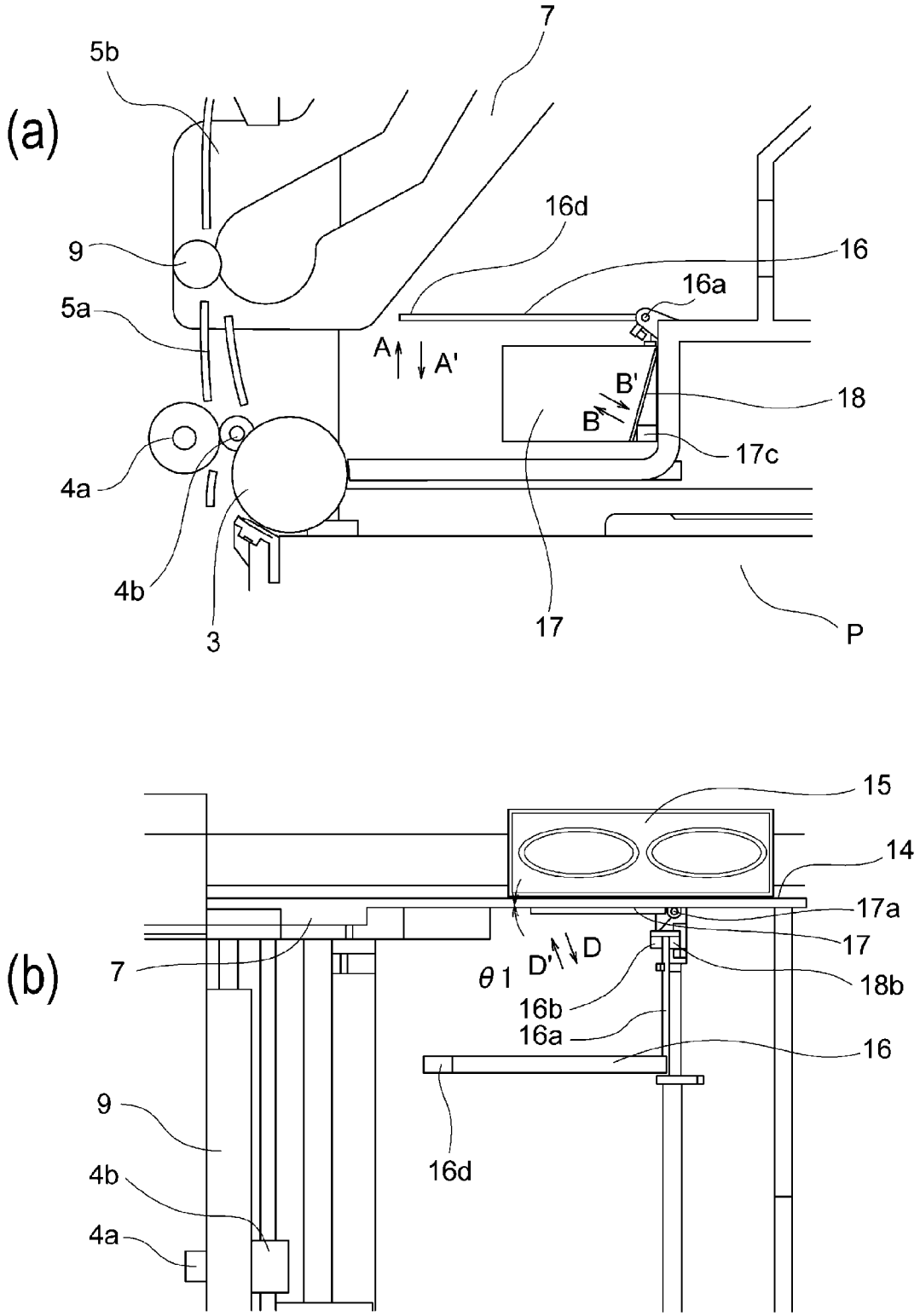
In FIGS. 4, (*a*) and 4(*b*) are vertical sectional views, and top view, respectively, of the portions of the image forming apparatus in the first embodiment, which are relevant to the present invention, when a cartridge of the small size is not in the cartridge chamber in the apparatus (secondary transfer station).

Further, the image forming apparatus 1 is provided with a fan 15 (FIG. 4(*b*)), which functions as a part of an air feeding device, which is for cooling the cartridge C in the transfer station T (cartridge bay), into which the cartridge C was guided along the cartridge guide 7. The fan 15 is attached to the right lateral plate 14 of the image forming apparatus 1.

The image forming apparatus 1 in this embodiment is structured so that the cartridge C is inserted into the designated cartridge position in the apparatus along the cartridge guide 7. The image forming apparatus has a changing device which changes the apparatus 1 in the state in which air is fed to the transfer station T (cartridge bay) to cool the cartridge C in the transfer station T (cartridge bay), according to the shape and/or size of the cartridge C.

Figure 2:
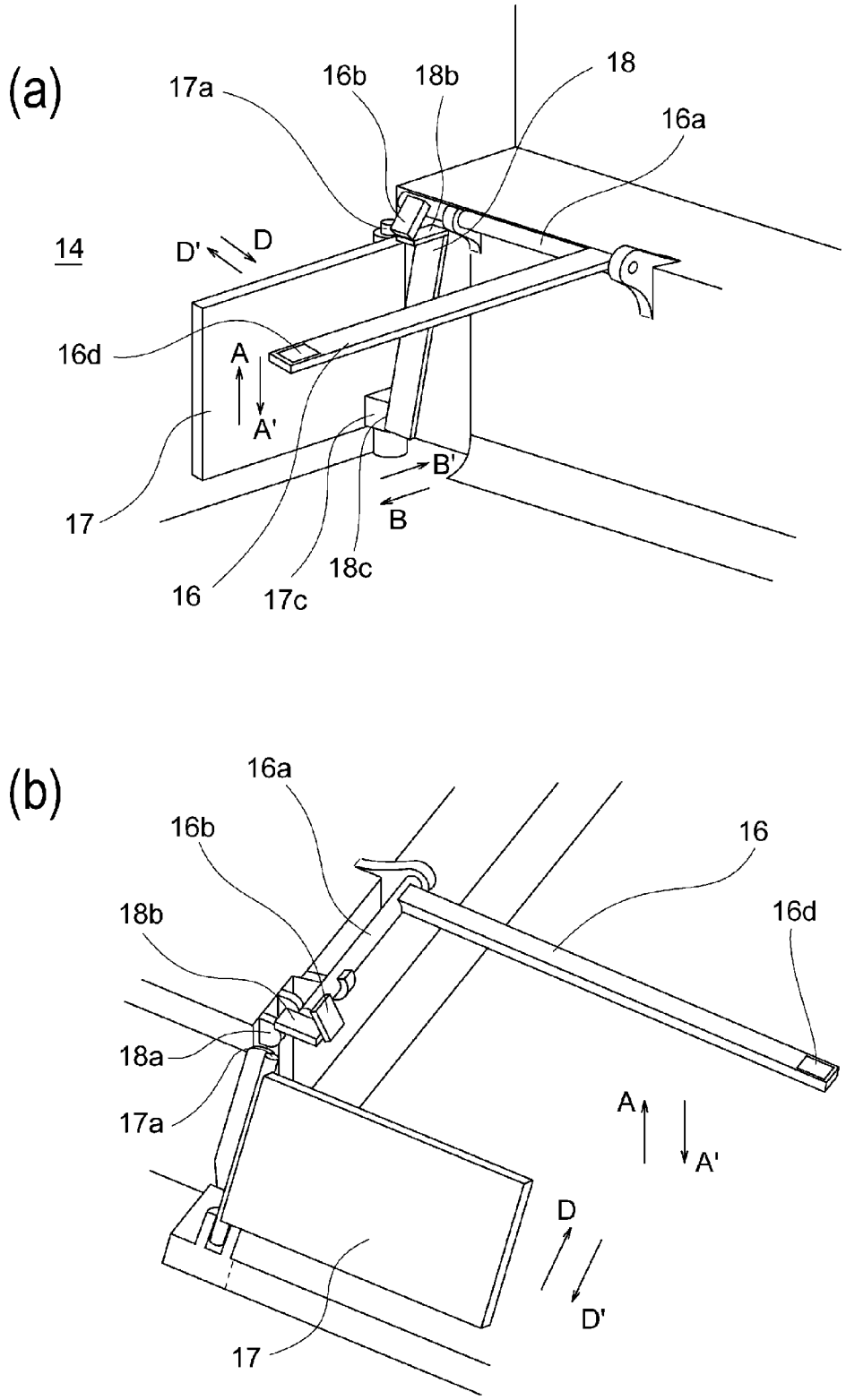
In FIGS. 2, (*a*) and (*b*) are perspective views of the combination of the lever and airflow adjustment plate, and its adjacencies, of the image forming apparatus in the first embodiment, and show how the plate is moved by the movement of the lever.

Next, referring to FIG. 2, the image forming apparatus 1 has a changing device for changing the fan 15 in the state of the airflow which the fan 15 generates. The changing device has a lever 16 (cartridge contacting member), into which the cartridge C is inserted into the transfer station T (cartridge bay). The lever 16 is changed in position according to the shape and/or size of the cartridge C, by coming into contact with the outward surface of the cartridge C. The changing device has also an airflow adjustment plate 17, which is on the downstream side of the fan 15, in terms of the airflow direction, and can be changed in attitude. Further, the changing device has a lever linkage 18 which is moved by the movement of the lever 16 to change the airflow adjustment plate 17 in attitude.

More concretely, the lever 16 is changed in attitude by the external shape of the cartridge C, and the airflow adjustment plate 17 is changed in attitude by the changes in the attitude of the lever 16, which is transmitted to the airflow adjustment plate 17 through the lever linkage 17. That is, the state of the airflow is changed in accordance with the shape and/or size of the cartridge C. In other words, the image forming apparatus 1 is structured so that it is changed in the state of its internal airflow by the change in the attitude of the lever 16. Therefore, how and where the airflow generated by the fan 15 is directed to cool the cartridge C in the transfer station T (cartridge bay) of the image forming apparatus 1 is changed according to the shape and/or size of the cartridge C.

In this embodiment, the direction in which air is fed into the transfer station T (cartridge bay) of the image forming apparatus 1 to cool the cartridge C in the transfer station T (cartridge bay) is changed in accordance with the external shape and/or size of the cartridge C. That is, as a process cartridge C is inserted into the transfer station T (cartridge bay), the direction in which air is fed into the transfer station T (cartridge bay) by the fan 15 is changed by the changing device according to the shape and/or size of the cartridge C.

Figure 3:
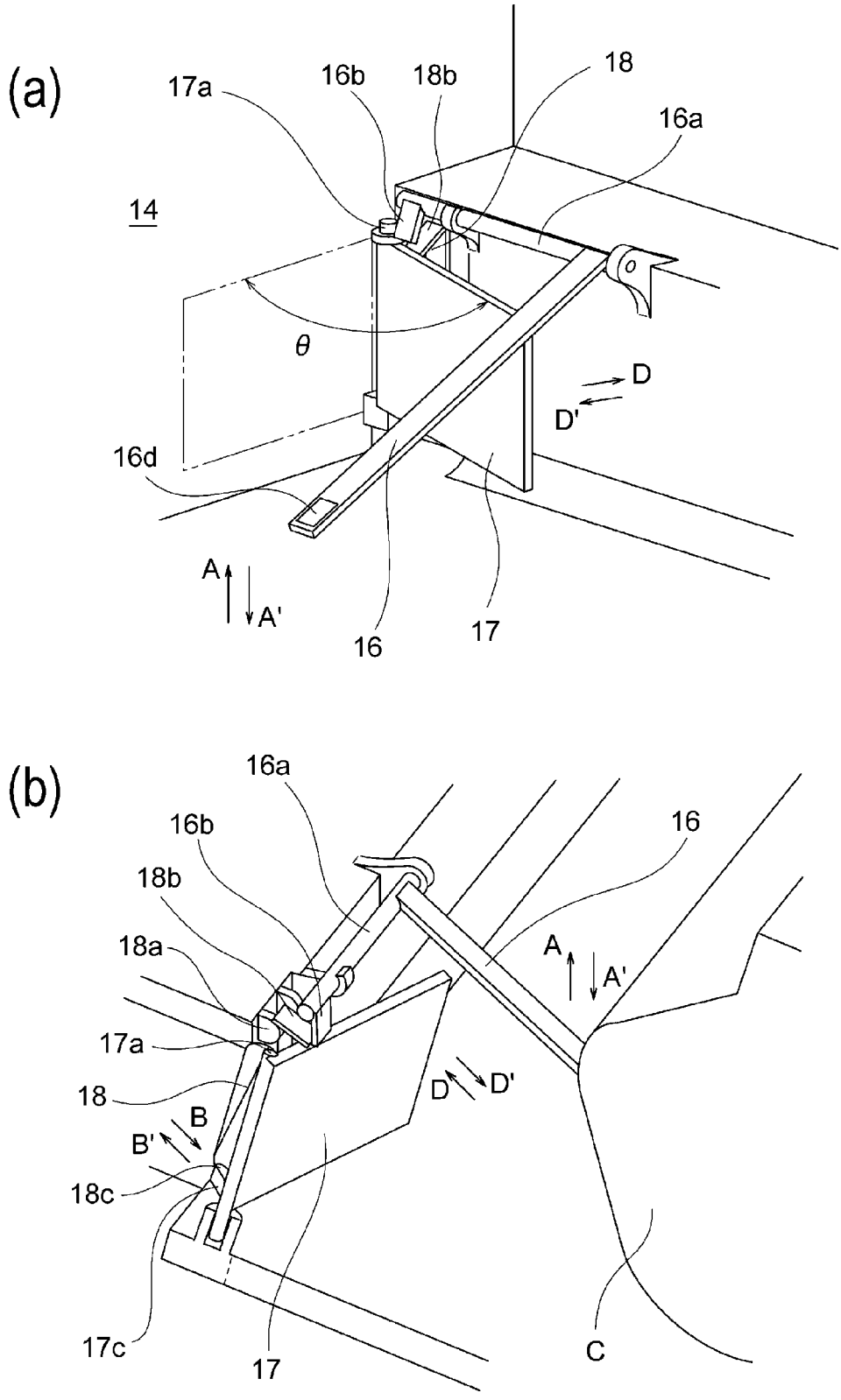
In FIGS. 3, (*a*) and 3(*b*) are also perspective views of the combination of the lever and airflow adjustment plate, and its adjacencies, of the image forming apparatus in the first embodiment, and show how the plate is moved by the movement of the lever.

FIGS. 2 and 3 are perspective views of the combination of the lever 16 (attitude of which is affected by the shape and/or size of the cartridge C), the airflow adjustment plate 17 (attitude of which is affected by the amount of the change in the attitude of the lever 16), and the adjacencies of the combination. They show the movement of the airflow adjustment plate, which is caused by the change in the attitude of the lever 16. FIGS. 2(*a*) and 3(*a*) show the attitude of the lever 16, attitude of the lever linkage 18, and attitude of the airflow adjustment plate 17, before the installation of the cartridge C, whereas FIGS. 2(*b*) and 3(*b*) show the attitude of the of the lever 16, attitude of the lever linkage 18, and attitude of the airflow adjustment plate 17, after the installation of the cartridge C. It should be noted here that FIGS. 2 and 3 do not show the right lateral plate 14 of the image forming apparatus 1.

FIGS. 2(*a*) and 3(*a*) are perspective views of the portion of the image forming apparatus 1, which is on the inward side of the right lateral plate 14 of the image forming apparatus 1, as seen from the inward side of the apparatus 1, whereas FIGS. 2(*b*) and 3(*b*) are perspective views of the portion of the image forming apparatus 1, which is on the inward side of the right lateral plate 14 of the image forming apparatus 1, as seen from the outward side of the apparatus 1.

Referring to FIGS. 2 and 3, the image forming apparatus 1 is provided with the lever 16, which is rotatably supported by the frame of the image forming apparatus 1 so that it can be rotationally moved about the axial line of the rotational shaft 16*a*. Next, referring to FIG. 4(*b*), the image forming apparatus 1 is provided with the airflow adjustment plate 17, which is on the downstream side of the fan 15 in terms of the air feeding direction, and is rotationally movable about the rotational axis of the rotational shaft 17*a*, which is rotatably supported by the frame of the image forming apparatus 1.

Further, the image forming apparatus 1 has the lever linkage 18, which has a pair of contacting portions 18*b* and 18*c*, which are the lengthwise end portions of the linkage 18, one for one. The contacting portion 18*b* is in contact with the contacting portion 16 *b* of the lever 16. The contacting portion 18*c* can be placed in contact with the contacting portion 17*c* of the airflow adjustment plate 17. The lever linkage 18 is rotatable about the axis of the rotational shaft 18*a* which is rotatably supported by the frame of the image forming apparatus 1. The lever linkage 18 is rotated by an angle θ, which is the angle between the airflow adjustment plate 17 and right lateral plate 14, shown in FIG. 3(*a*), about the axis of the rotational shaft 18*a*, in proportion to the change in the attitude of the lever 16 which is pivotally moved about the axis of the rotational shaft 16*a*, while sliding on the lever contacting area of the outward surface of the cartridge C.

The lever 16 is kept pressed by an unshown spring, as a pressure applying means, in the direction indicated by an arrow mark A in FIGS. 2(*a*) and 3(*a*). When the cartridge C is not in the image forming apparatus 1, the lever 16 remains in contact with the lever contacting portion 18*b* of the lever linkage 18. Further, the lever linkage 18 is kept pressed by an unshown spring, as a pressure applying means, in the direction indicated by an arrow mark B in FIGS. 2(*a*) and 2(*b*). Thus, the contacting portion 18*c* of the lever linkage 18 remains in contact with the lever linkage contacting portion 17*c* of the airflow adjustment plate 17. Further, the airflow adjustment plate 17 is kept pressed by an unshown spring, as a pressure applying means, in the direction indicated by an arrow mark D in FIGS. 2(*a*) and 2(*b*). Thus, the lever linkage contacting portion 17*c* remains in contact with the contacting portion 18*c* of the lever linkage 18.

Until the cartridge C is installed into the image forming apparatus 1, the contacting portion 17*c* of the airflow adjustment plate 17 remains in contact with the contacting portion 18*c* of the lever linkage 18 which is under the pressure applied by the unshown spring. Thus, the airflow adjustment plate 17 is kept pressed in the direction indicated by an arrow mark D'. Thus, the angle θ between the airflow adjustment plate 17 and right lateral plate 14 is zero.

Referring to FIGS. 3(*a*) and 3(*b*), as the cartridge C is moved into the transfer station T (cartridge bay), the cartridge C is caught by the cartridge contacting portion of the lever 16. Thus, as the cartridge C is moved further into the transfer station T (cartridge bay), the contacting portion 16*d* of the lever 16 is forced to slide on the outward surface of the cartridge C. Consequently, the lever 16 is rotated downward, that is, the direction indicated by an arrow mark A' in FIGS. 3(*a*) and 3(*b*). Thus, the contacting portion 18*c* of the lever linkage 18, which is in contact with the contacting portion 16*b* of the lever 16, is pressed by the contacting portion 16*b*. Thus, the lever linkage 18 is rotated about the axis of the rotational shaft 18*a* of the lever linkage 18 by an angle θ in the direction indicated by an arrow mark B' in FIGS. 3(*a*) and 3(*b*). Consequently, the airflow adjustment plate 17 is rotationally moved in the direction indicated by an arrow mark D in FIGS. 3(*a*) and 3(*b*), creating thereby an air passage, the airflow angle of which relative to the right lateral plate 17 is θ.

FIG. 4(*a*) is a vertical sectional view of the image forming apparatus 1 before the installation of the cartridge C into the image forming apparatus 1, and FIG. 4(*b*) is a horizontal sectional view of the image forming apparatus 1 at a plane E-E in FIG. 1, before the installation of the cartridge C into the image forming apparatus 1. Until the cartridge C is installed into the image forming apparatus 1, the lever 16 is in its first position shown in FIGS. 4(*a*) and 4(*b*), and the lever linkage 18 which is moved by the movement of the lever 16, keeps the airflow adjustment plate 17 in such a position that causes the angle θ of the airflow adjustment plate 17 relative to the right lateral plate 14 to be θ1 (first angle=zero).

Figure 5:
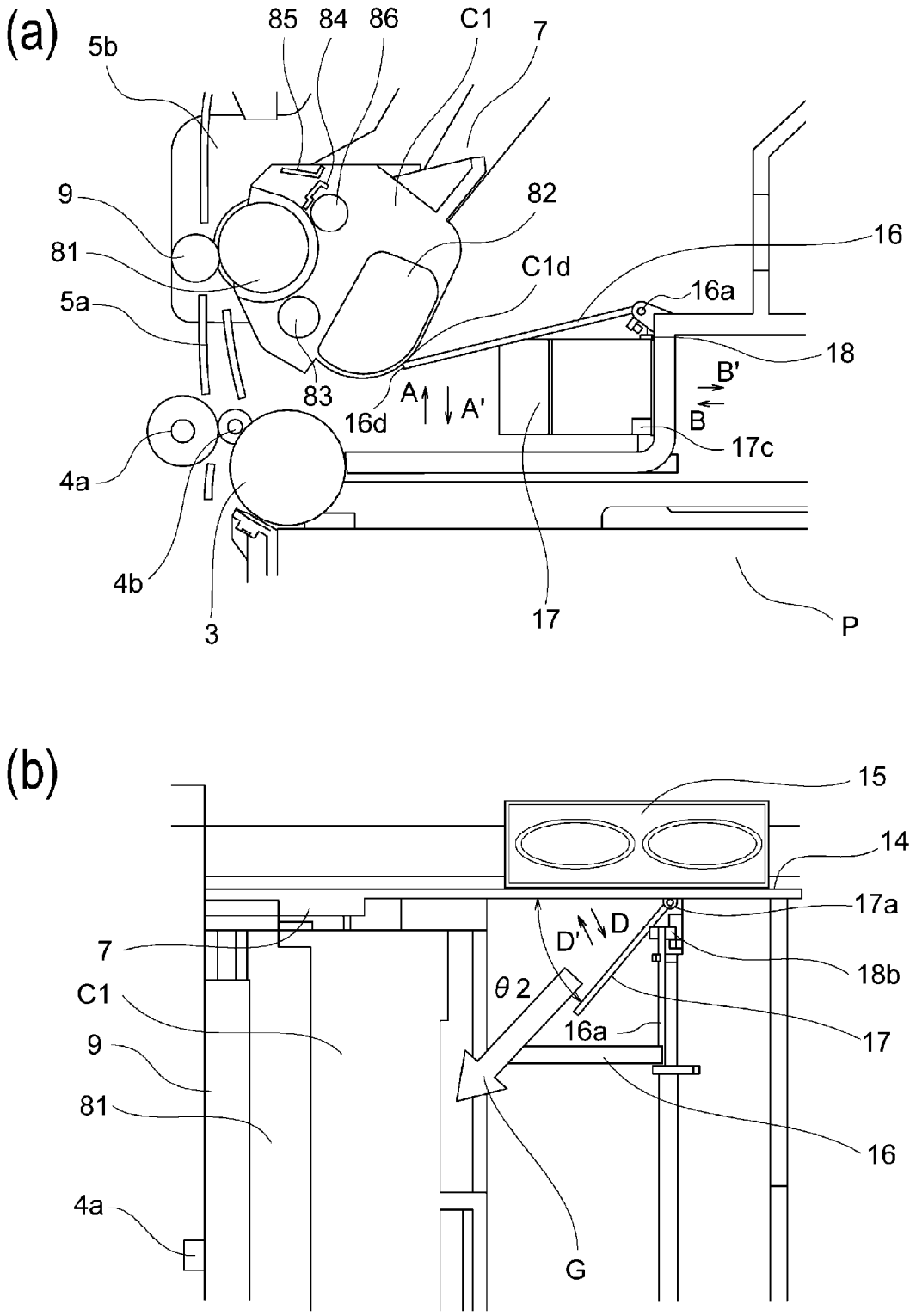
In FIGS. 5, (*a*) and 5(*b*) are vertical sectional views, and top view, respectively, of the portions of the image forming apparatus in the first embodiment, which are relevant to the present invention, when a cartridge of the small size is in the cartridge chamber in the apparatus (secondary transfer station).

FIG. 5(*a*) is a vertical sectional view, and a horizontal sectional view, at the plane E-E in FIG. 1, respectively, of the image forming apparatus 1 after the installation of a cartridge C1, which is a cartridge of the small size (which hereafter may be referred to simply as small cartridge C1), into the transfer station T (cartridge bay) of the image forming apparatus 1, along the cartridge guide 7. Referring to FIG. 5(*a*), the lever 16 has been rotationally moved about the axis of the rotational shaft 16*a* by the cartridge C1 in such a manner that the contacting portion 16*a* of the lever 16 slides on the lever catching portion C1*d* of the outward surface of the cartridge C1. That is, the lever 16 has been rotationally moved downward in the direction indicated by an arrow mark A' in FIG. 5(*a*), into its second position shown in FIG. 5(*a*). That is, the lever 16 is positioned in its second position by its contact with the lever contacting portion C1*d* of the cartridge C1.

As the lever 16 is rotationally moved as described above, the lever linkage 18, which is moved by the movement of the lever 16, is rotationally moved in the direction indicated by an arrow mark B' in FIG. 5(*a*), and holds the airflow adjustment plate 17 in the second position for the airflow adjustment plate 17, in which the angle θ between the airflow adjustment plate 17 and right lateral plate 14 is θ2 (θ2>θ1), which is shown in FIG. 5(*a*).

Referring to FIG. 5(*b*), the direction indicated by an arrow mark G, that is, the direction in which the airflow adjustment plate 17 directs the airflow when it is at its second position (angle θ2), is such a direction that is suitable for cooling the small cartridge C1 shown in FIG. 5. The value for the second angle θ2, shown in FIG. 5(*b*), is to be set according to the external shape and/or size of the small cartridge C1.

Figure 6:
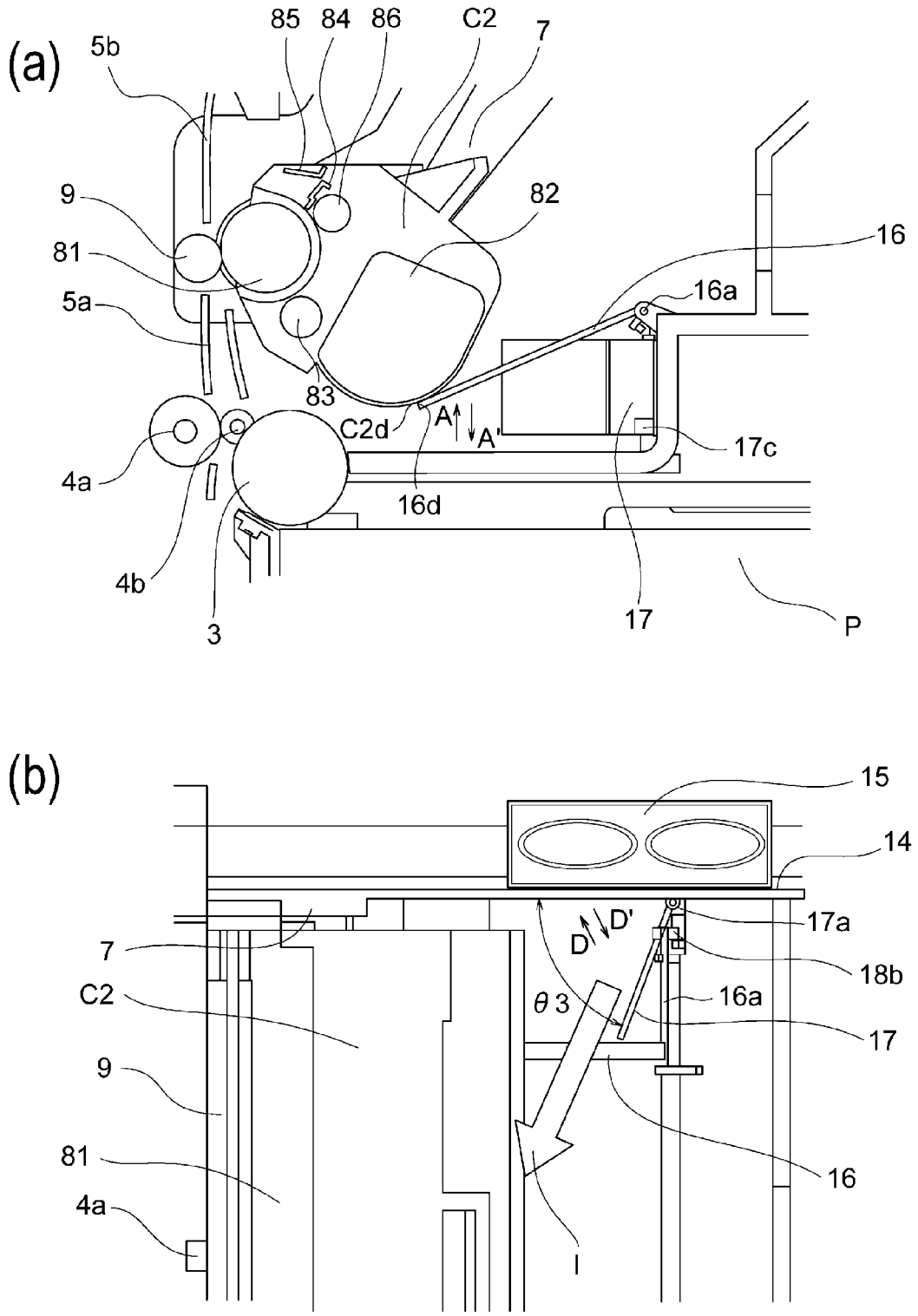
In FIGS. 6, (*a*) and 6(*b*) are vertical sectional views, and top view, respectively, of the portions of the image forming apparatus in the first embodiment, which are relevant to the present invention, when a cartridge of the large size is in the cartridge chamber in the apparatus (secondary transfer station).

FIGS. 6(*a*) and 6(*b*) are vertical sectional, and a horizontal sectional views, at the plane E-E in FIG. 1, respectively, of the image forming apparatus 1 after the installation of the cartridge C2, or the cartridge C of the large size (which hereafter may be referred to simply as large cartridge C2, into the transfer station T (cartridge bay) of the image forming apparatus 1, along the cartridge guide 7.

In comparison to the lever contacting portion C1*d* of the outward surface of the small cartridge C1 shown in FIG. 5, the lever contacting portion C2*d* of the outward surface of the large cartridge C2 shown in FIG. 6 protrudes more toward the lever 16. The direction in which the contacting portion C1*d* protrudes is such a direction that as the large cartridge C2 is inserted into the second transfer station T, it causes the lever 16 to rotate about the axial line of the rotational shaft 16*a* of the lever 16, in the direction indicated by an arrow mark A' in FIG. 6(*a*), while causing the contacting portion 16*d* of the lever 16 to slide on the lever contacting portion C2*d* of the cartridge C2. That is, the direction is such a direction that presses the lever 16 downward. Incidentally, the reason why the lever contacting portion C2*d* of the large cartridge C2 protrudes more toward the lever 16 than the lever contacting portion C1*d* of the small cartridge C1 is that the cartridge C2 is greater in the amount by which it stores toner in its toner container 82 than the amount by which the cartridge C1 contains toner in its toner container 82.

Therefore, the amount of downward displacement of the large cartridge C2, shown in FIG. 6(*a*), which occurs as the large cartridge C2 is inserted into the transfer station T (cartridge bay) of the image forming apparatus 1 along the cartridge guide 7, is as follows. That is, it is greater than the amount of downward displacement of the small cartridge C1, shown in FIG. 5(*a*), which occurs as the small cartridge C1 is installed into the transfer station T (cartridge bay) of the image forming apparatus 1 along the cartridge guide 7.

Referring to FIG. 6(*a*), the cartridge contacting portion 16*d* of the lever 16 is pushed down by the large cartridge C2 in the direction indicated by the arrow mark A' in FIG. 6(*a*), into the third position shown in FIG. 6(*a*), while being forced to slide on the lever contacting portion C2*d* of the cartridge C2. That is, the lever 16 is positioned in its third position by its contact with the lever contacting portion C2*d* of the large cartridge C2.

Thus, the lever linkage 18, which is moved by the movement of the lever 16, ends up holding the airflow adjustment plate 17 in such a position that causes the angle θ between the airflow adjustment plate 17 and right lateral plate 14 to be θ3 as shown in FIG. 6(*b*) (θ3>θ2).

Next, referring to FIG. 6(*b*), the direction indicated by an arrow mark I in FIG. 6(*b*), that is, the direction in which the airflow generated by the fan 15 is directed by the airflow adjustment plate 17 when the plate 17 is held in the third position, in which the angle θ, shown in FIG. 6(*b*), between the plate 17 and right lateral plate 14 is θ3, is the proper direction for cooling the large cartridge C2 shown in FIG. 6. The value of the third rotational angle θ3 for the airflow adjustment plate 17, shown in FIG. 6(*b*), is to be set according to the external shape and/or size of the large cartridge C2. There is the following relationship between the second rotational angle θ2 and the third rotational angle θ3: θ2<θ3. That is, as the large cartridge C2 is installed into the transfer station T (cartridge bay) of the image forming apparatus 1 along the cartridge guide 7, the rotational angle θ of the airflow adjustment plate 17 becomes the third rotational angle θ3. That is, it becomes larger than when the small cartridge C1 is installed. Further, the airflow adjustment plate 17 directs the airflow so that the airflow envelops the entirety of the large cartridge C2.

On the other hand, in a case where the small cartridge C1 is installed into the transfer station T (cartridge bay) of the image forming apparatus 1 along the cartridge guide 7 as shown in FIG. 5(*b*), the rotational angle θ of the airflow adjustment plate 17 becomes the second rotational angle θ2, which is smaller than the rotational angle θ3. That is, the airflow adjustment plate 17 is angled so that the airflow directed by the airflow adjustment plate 17 envelopes the entirety of the small cartridge C1.

As the cartridge C is removed from the image forming apparatus 1, the lever 16 and lever linkage 18 are returned to their first position, shown in FIG. 4(*a*), by the force generated by the unshown springs as pressure applying means. As for the airflow adjustment plate 17, it is rotationally moved, in the direction indicated by the arrow mark D' in FIG. 4(*b*) by the pressure applied by the lever linkage 18, until its angle θ relative to the right lateral plate 17 reduces to the first rotational angle θ1 (=0).

To sum up, referring to FIG. 5(*b*), in this embodiment, as the small cartridge C1 is installed into the transfer station T (cartridge bay) of the image forming apparatus 1 along the cartridge guide 7 as shown in FIG. 5(*b*), the airflow adjustment plate 17 is positioned so that it directs the airflow as indicated by the arrow mark G in FIG. 5(*b*) to efficiently cool the small cartridge C1.

Further, referring to FIG. 6(*b*), in a case where the large cartridge C2 is installed into the transfer station T (cartridge bay) along the cartridge guide 7, the airflow adjustment plate 17 is positioned so that it directs the airflow as indicated by the arrow mark I in FIG. 6(*b*) to efficiently cool the larger cartridge C1.

As described above, the image forming apparatus 1 is structured so that both the cartridges C1 and C2, which are different in size, can be installed into the transfer station T (cartridge bay) along the cartridge guide 7, and also, so that the angle θ by which the airflow adjustment plate 17, which is for directing the airflow generated by the fan 15, is rotationally moved, is changed according to the cartridge size. Therefore, the image forming apparatus 1 in this embodiment can properly and efficiently cool the cartridge C in its transfer station T, regardless of the shape and/or size of the cartridge C. Thus, the image forming apparatus 1 in this embodiment is unlikely to suffer from the problem attributable to the excessive increase in the temperature of the cartridge C, and therefore, can remain excellent in image quality.

Embodiment 2

Figure 7:
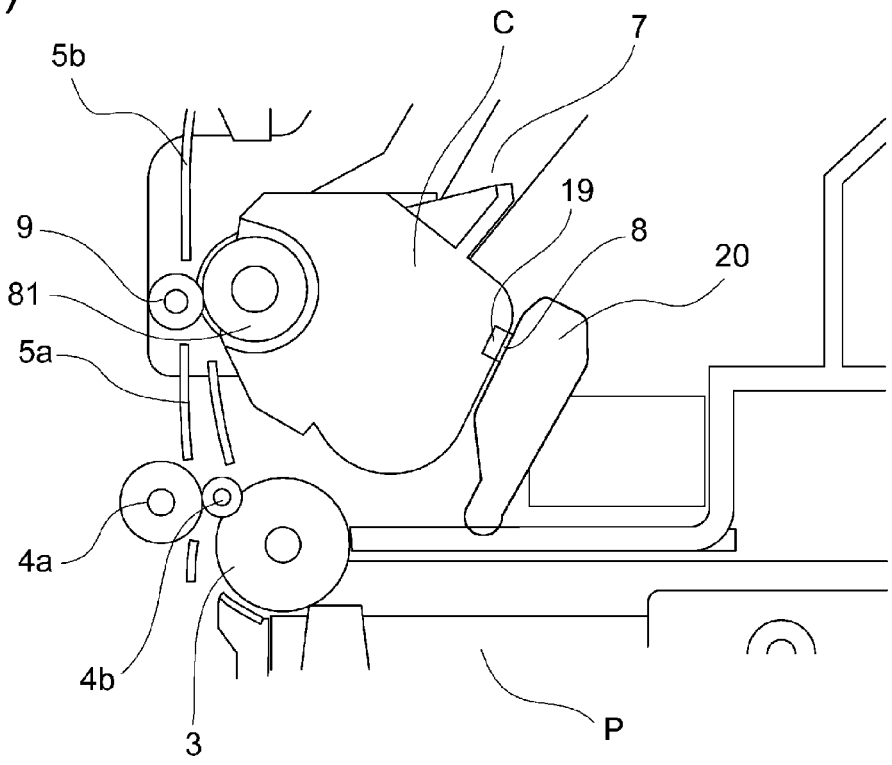
In FIG. 7, (*a*) is a vertical sectional view of the portions of the image forming apparatus in the second embodiment, which are relevant to the present invention, when a cartridge is in the cartridge chamber in the apparatus (secondary transfer station), and shows the structure of the portions.
Figure 7:
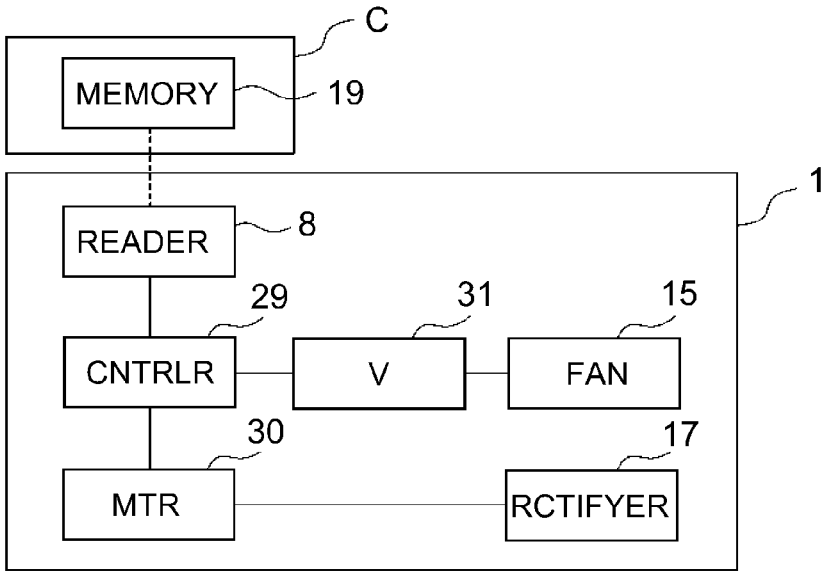

Next, referring to FIG. 7, the image forming apparatus in the second embodiment of the present invention is described about its structure. Incidentally, the portions of the image forming apparatus in this embodiment, which are the same in structure as the counterparts in the first embodiment, are given the same referential codes, one for one, and are not described.

In this embodiment, the two cartridges C which are different in external shape and/or size are provided with a memory 19 as storage means for storing the information about the shape and/or size of the cartridge C.

Further, the image forming apparatus is provided with a changing device for changing the state of the airflow generated by the fan 15 to cool the cartridge C in the transfer station T (cartridge bay), into which the cartridge C was installed along the cartridge guide 7. The changing device with which the main assembly of the image forming apparatus 1 in this embodiment is provided with a reading portion 8, which reads the information about the shape and/or size of the cartridge C, which is in the memory 19 (storage portion) of each cartridge C.

Referring to FIG. 7(*b*), the fan 15 is controlled by a control section 29 as a controlling means, according to the information regarding the shape and/or size of the cartridge C, which is read by the reading portion 8, or a motor 30 as a driving means is controlled by the control section 29 to control the airflow adjustment plate 17 in its angle θ relative to the right lateral plate 14, through an unshown driving force transmitting means. That is, the image forming apparatus 1 in this embodiment is structured so that it is changeable in the state of the airflow generated by the fan 15.

An example of the memory 19 is a RFID (Radio Frequency Identification Tag). Generally speaking, a RFID tag is provided with an antenna coil, and a control circuit which is in the form of a semiconductor IC chip. It electronically stores information. It wirelessly exchanges information with an external read/write device, with the use of electromagnetic waves. As the reading portion 8, a reading device which can wirelessly receive information from the RFID tag can be used.

As the cartridge C is inserted into the transfer station T (cartridge bay) along the cartridge guide 7, communication is automatically started between the RFID tag of the cartridge C and the reading device (reading portion 8) positioned in the main assembly of the image forming apparatus 1 so that the information regarding the shape and/or size of the cartridge C, which is in the memory 19, can be read by the reading device (reading portion 8).

The direction in which the airflow is aimed to properly and efficiently cool the cartridge C, and the proper velocity for the airflow for efficiently cooling the cartridge C, are affected by the external shape and/or size of the cartridge C. Therefore, the amount by which airflow is generated by the fan 15 has to be adjusted according to the external shape and/or size of the cartridge C.

In this embodiment, the amount by which airflow is to be generated by the fan 15 is adjusted according to the information regarding the shape and/or size of the cartridge C, which is in the memory 19 of the cartridge C, and is read by the reading portion 8.

FIG. 7(*a*) is a vertical sectional view of the image forming apparatus 1 in this embodiment, and shows the structure of the apparatus 1. Referring to FIG. 7(*a*), the image forming apparatus 1 is provided with the reading portion 8 which reads the information regarding the shape and/or size of the cartridge C, and a lever 20 which holds the reading portion 8 and is rotationally movable. Further, the image forming apparatus 1 is structured so that as the cartridge C is inserted into the transfer station T (cartridge bay) of the image forming apparatus 1, the reading portion 8 comes into contact with the memory 19 of the cartridge C.

Further, the image forming apparatus 1 is structured so that the cartridge contacting lever 20 places the reading portion 8 in contact with the memory 19 regardless of the external shape and/or size of the cartridge C. Until the cartridge C is installed into the transfer station T (cartridge bay), the lever 20 remains in its home position, into which the lever 20 retreats from the cartridge guide 7, in order not to interfere with the installation of the cartridge C.

The amount Q by which air is moved by the fan 15 to cool the cartridge C is controlled by the control section 29 disposed in the image forming apparatus 1 as shown in FIG. 7(*b*); the control section 29 controls the fan 15 in revolution.

When the cartridge C is not in the image forming apparatus 1, the volume Q1 by which air is moved by the fan 15 is zero: Q1=0 ($m^3$/min). However, as the small cartridge C1, shown in FIG. 5(*a*), is installed, the volume Q by which air is moved by the fan 15 is increased to Q2 (Q2>Q1) by the control section 29. Further, as the large cartridge C2, shown in FIG. 6(*a*), is installed, the volume Q by which air is moved by the fan 15 is changed to Q3 (Q3>Q2) by the control section 29.

There is the following relationship between the volume Q2 by which air is moved by the fan 15, and the volume Q3 by which air is moved by the fan 15: Q2<Q3.

That is, in this embodiment, in a case where the small cartridge C1, shown in FIG. 5(*a*), is installed into the transfer station T (cartridge bay) (cartridge chamber) in the image forming apparatus 1, the volume Q by which air is moved by the fan 15 is set the volume Q2 which is suitable to cool the small cartridge C1.

In comparison, in a case where the large cartridge C2, shown in FIG. 6(*a*), is installed into the transfer station T (cartridge bay) in the image forming apparatus 1, the volume Q by which air is moved by the fan 15 is changed to the volume Q3, which is suitable for cooling the large cartridge C2.

That is, in this embodiment, the volume Q by which air is moved by the fan 15 is adjusted according to the external shape and/or size of the cartridge C, which is to be installed into the transfer station T (cartridge bay) of the image forming apparatus 1 along the cartridge guide 7. The effects of this embodiment are the same as those in the first embodiment.

In addition, the control section 29 controls an electric power source 31, as an electric power supplying means, to change the electric current to be supplied to the fan 15. Therefore, the fan 15 does not generate an excessive amount of airflow. That is, this embodiment can optimize the image forming apparatus 1 in electric power consumption.

In this embodiment, the control section 29 controls the electric power source 31 to change the electric current to be supplied to the fan 15. However, instead of changing the amount by which air is moved by the fan 15, the control section 29 may control the motor 30 to control the airflow adjustment plate 17 in its angle relative to the right lateral plate 14 through an unshown driving force transmitting means. In other words, the direction in which airflow is generated by the fan 15 may be changed as in the first embodiment to change the state of airflow. In this embodiment, the changing device for changing the state in which air is fed to cool the cartridge C is the combination of the memory 19 with which the cartridge C is provided, and the reading portion 18 with which the main assembly of the image forming apparatus 1 is provided. However, this embodiment is not intended to limit the present invention in terms of the changing device. For example, the changing device may be such that the control section 29 uses a mechanical system which employs a lever such as the lever 16 in the first embodiment which comes into contact with the cartridge C, in order to change the amount by which air is moved by the fan 15.

Further, in addition to changing the amount by which air is moved by the fan 15, the direction in which the airflow generated by the fan 15 is aimed may be changed. Otherwise, the image forming apparatus 1 in this embodiment is the same in structure as the one in the first embodiment, and its effects are the same as those in the first embodiment. That is, the cartridge C in the image forming apparatus 1 can be properly and efficiently cooled according to the external shape and/or size of the cartridge C; the cartridge C can be properly and efficiently cooled regardless of its external shape and/or size. In other words, this embodiment also can reduce an image forming apparatus in the problem attributable to the excessive increase in the temperature of the cartridge C in the apparatus, and therefore, can keep the apparatus excellent in image quality.

Embodiment 3

Next, referring to FIGS. 8-15, the image forming apparatus in the third embodiment of the present invention is described about it structure. The components of this image forming apparatus, which are the same in structure as the counterparts in the first embodiment are given the same referential codes, one for one, as the counterparts, and are not described here.

In this embodiment, the image forming apparatus is provided with a changing device for changing the image forming apparatus in the state in which airflow is fed to cool the cartridge C in the transfer station T (cartridge bay), into which the cartridge C was inserted along the cartridge guide 7. This changing device is a combination of the memory 19, with which the cartridge C is provided, and a cartridge contacting lever 20 having the reading portion 8 which reads the information regarding the shape and/or size of the cartridge C, which is in the memory 19.

Figure 10:
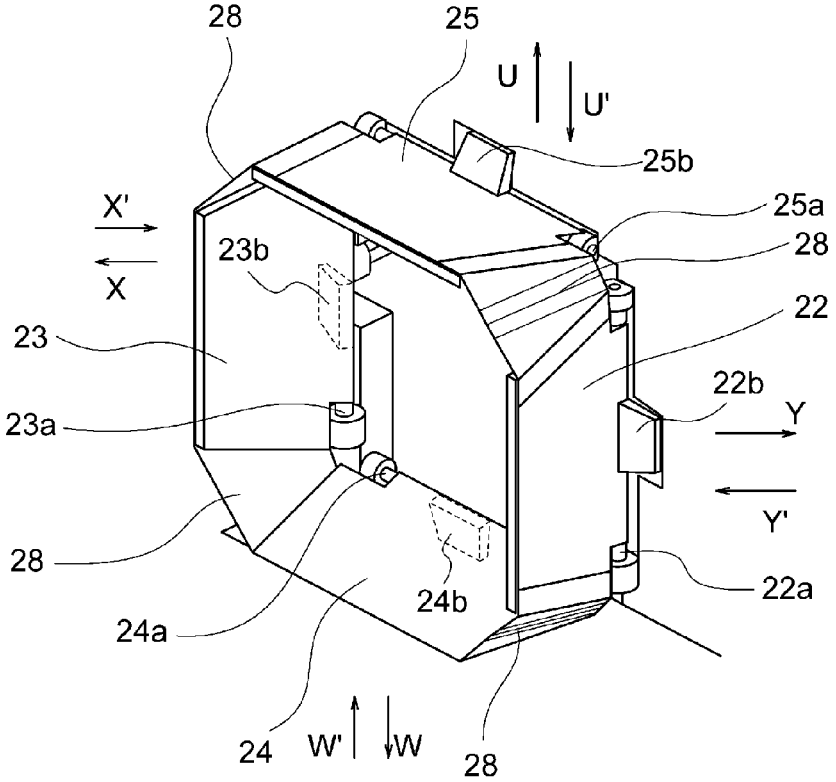
FIG. 10 is a perspective view of the air feeding device in the third embodiment, and is for describing the structure of the air feeding device.

Further, referring to FIG. 10, the image forming apparatus 1 has multiple airflow adjustment plates 22-25, which are disposed on the downstream side of the fan 21 to control (adjust) the airflow generated by the fan 15 to cool the cartridge C in the transfer station T (cartridge bay), into which the cartridge C was inserted along the cartridge guide 7. The airflow adjustment plates 22-25 are adjustable in position (attitude, angle). Next, referring to FIG. 11, the image forming apparatus 1 has also a connecting member 27 which is a changing device for changing the airflow adjustment plates 22-25 in position (attitude). These components are used to change in velocity the airflow generated by the fan 21, according to the shape and/or size of the cartridge C.

In order to properly and efficiently cool the cartridge C, the state in which the airflow is fed toward the cartridge C has to be changed according to the shape and/or size of the cartridge C. That is, the airflow generated by the fan 21 has to be changed in velocity according to the shape and/or size of the cartridge C.

Figure 8:
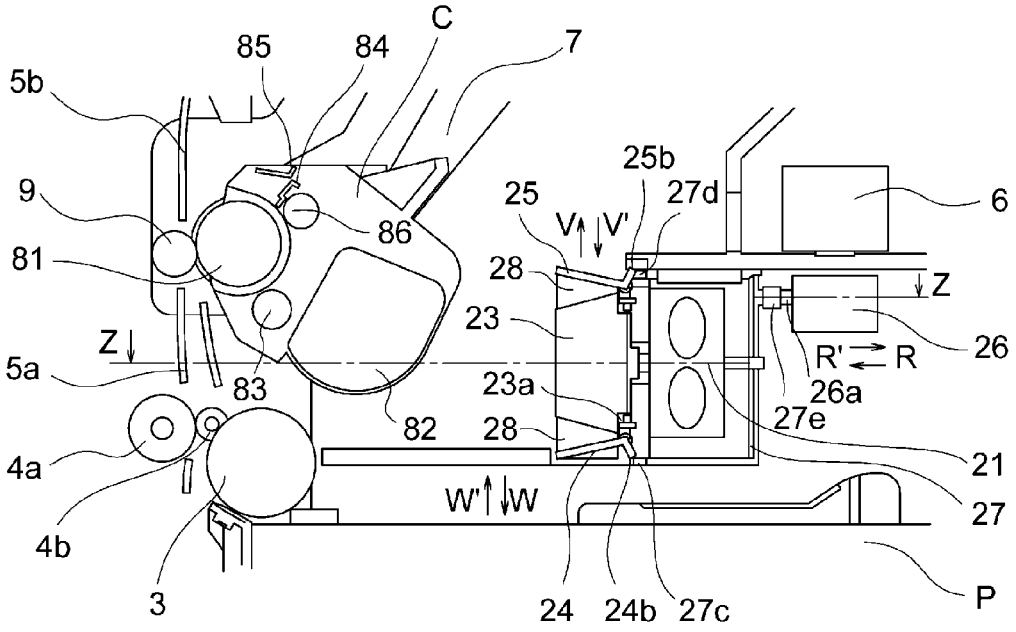
In FIG. 8, (*a*) is a vertical sectional view of the portions of the image forming apparatus in the third embodiment, which are relevant to the present invention, when a cartridge is in the cartridge chamber in the apparatus (secondary transfer station), and shows the structure of the portions.
Figure 8:
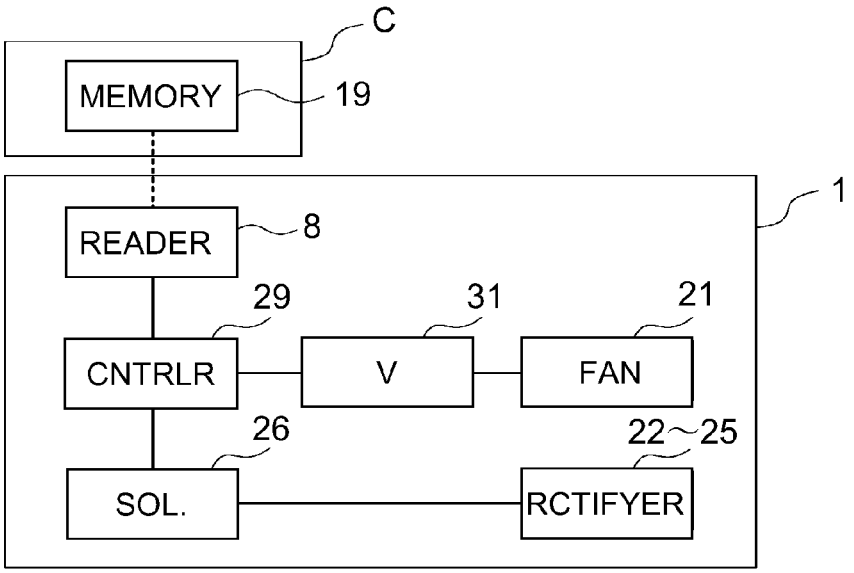
Figure 9:
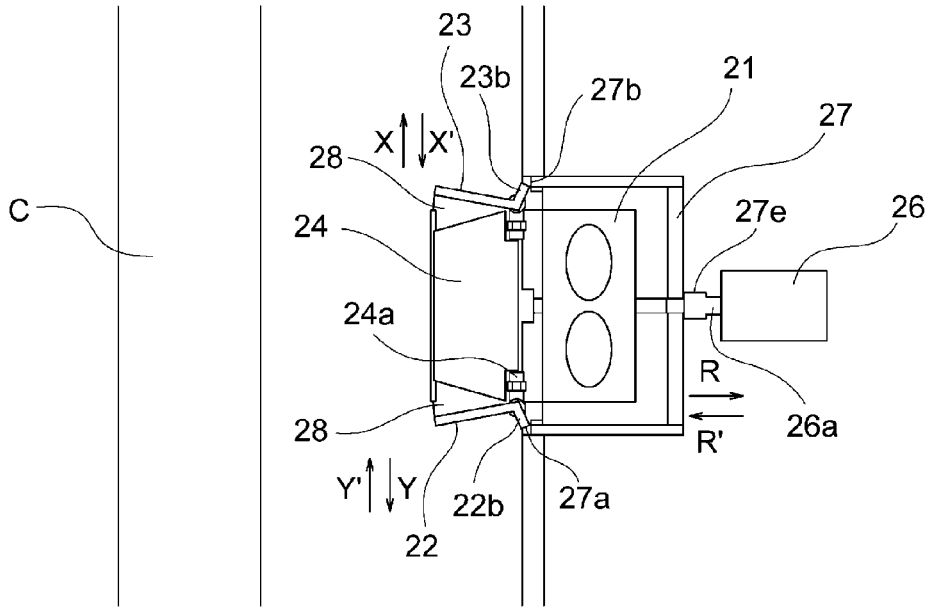
FIG. 9 is a sectional view of the air feeding device in the third embodiment, and is for describing the structure of the air feeding device.

FIG. 8(*a*) is a vertical sectional view of the image forming apparatus 1 in this embodiment. FIG. 8(*b*) is a block diagram of the control system of the image forming apparatus 1 in this embodiment. It shows the configuration of the system. FIG. 9 is a sectional view of the portions of the image forming apparatus 1, which are relevant to the present invention, at a plane Z-Z in FIG. 8(*a*). The fan 21 (as airflow generating portion), airflow adjustment plates 22-25, solenoid 26, and connecting member 27 are disposed as shown in FIGS. 8(*a*) and 9. In particular, the fan 21 is disposed in the top portion of the air duct portion S in such a manner that the airflow generated by the fan 21 is directed toward the cartridge C.

FIG. 10 is a perspective view of the air duct made up of the airflow adjustment plates 22-25. Referring to FIGS. 8(*a*) and 9, the airflow adjustment plates 22-25 are disposed on the downstream side of the fan 21 in terms of the airflow direction. Referring to FIG. 10, the airflow adjustment plates 22-25 are rotationally movable about the axis of their rotational shafts 22*a*-25*a*, respectively. Further, they are kept pressed in the directions indicated by arrow marks Y, X, W and U, respectively, by the unshown springs as pressure applying means.

Further, there is provided a piece 28 of film between the adjacent two airflow adjustment plates to prevent airflow from leaking through the intervals between the adjacent two airflow adjustment plates. Further, the airflow adjustment plates 22-25 have areas 22*b*-25*b* of contact, on which the contacting portions 27*a*-27*d* of the connecting member 27 slide, respectively.

The solenoid 26 has a movable core 26*a* (plunger) made of iron. It is controlled by the control section 29, shown in FIG. 8(*b*), based on the information regarding the shape and/or size of the cartridge C, which is read by the reading portion 8, with which the cartridge contacting lever 20 is provided. The movable core (plunger) 26*a* is movable in the direction indicated by an arrow mark R or R' in FIG. 8(*a*). One of the lengthwise ends of the movable core (plunger) 26*a* is in connection to the contact portion 27*e* of the connecting member 27 shown in FIG. 11.

Figure 11:
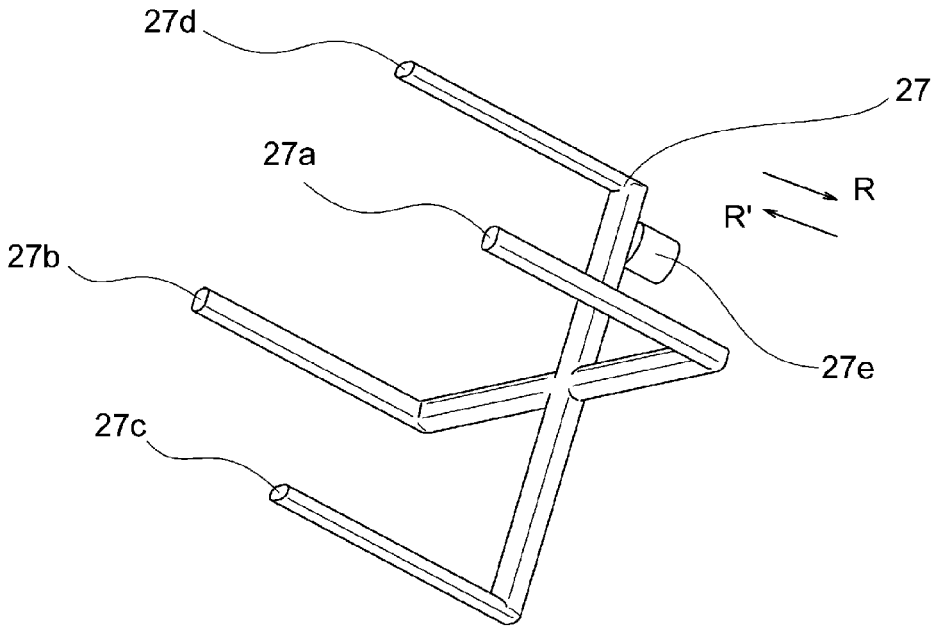
FIG. 11 is a perspective member for controlling the airflow adjusting plate, in the third embodiment, and is for describing the connective member.

Referring to FIG. 11, the connecting member 27 has contact portions 27*a*-27*d*, which contact the contact portions 22*b*-25*b* of airflow adjustment plates 22-25 and can slide thereon, respectively, in the direction indicated by the arrow mark R or R'. Thus, the connecting member 27 is movable by the movable core (plunger) 26*a* of the solenoid 26, shown in FIG. 9, in the direction indicated by the arrow mark R or R' in FIG. 9.

As the solenoid 29 is activated, the contact portions 27*a*-27*d* of the connecting member 27 which is movable in the direction indicated by the arrow mark R, or R' in FIG. 9, come into contact with, and press on, the areas 22*b*-25*b* contact of the airflow adjustment plates 22-25 which are rotatably supported by the rotational shafts 22*a*-25*a*, respectively, while sliding thereon. Thus, the airflow adjustment plates 22-25 are rotated about the axis of the rotational shafts 22*a*-25*a*. That is, the airflow adjustment plates 22-25 are adjusted in attitude (angle). As a result, the air duct (air passage) formed by the combination of the airflow adjustment plates 22-25 and pieces 28 of film, is changed in cross-sectional area, and therefore, the airflow generated by the fan 21 to cool the cartridge C is changed in velocity V. To sum up, the combination of the airflow adjustment plates 22-25 and pieces 28 of film forms the duct which guides the airflow generated by the fan 21 as the airflow moves through the duct. That is, the duct is changeable in cross-sectional area to change the airflow in velocity V.

Figure 12:
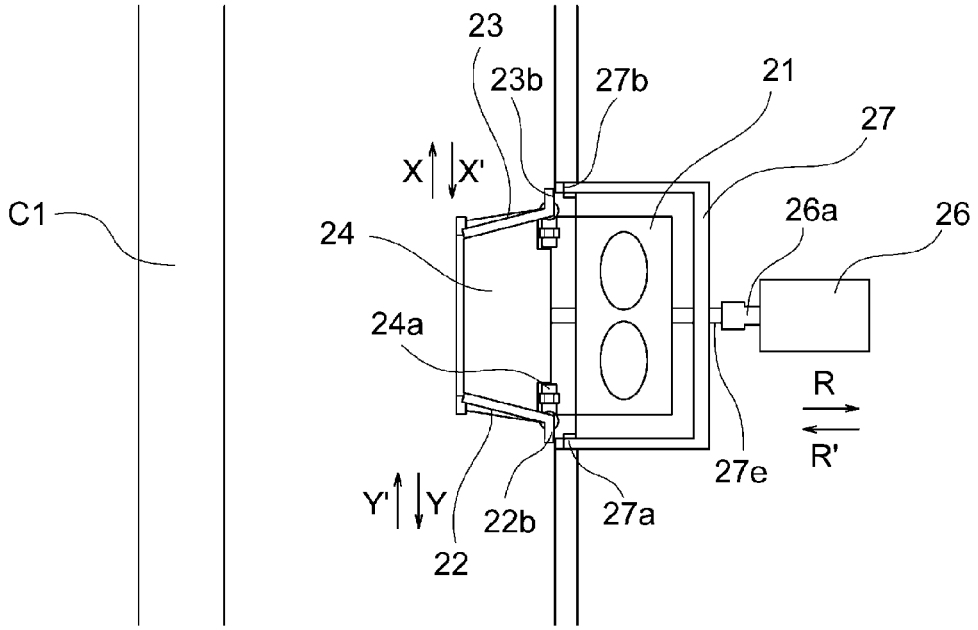
FIG. 12 is a sectional view of the air feeding device in the third embodiment, when the cartridge of the small size is in the cartridge chamber (secondary transfer station), and is for describing the structure of the air feeding device.

FIG. 12 is a sectional view of the portions of the image forming apparatus 1, which are relevant to the present invention, at a plane Z-Z in FIG. 8(*a*), when the cartridge C1, that is, the small cartridge, is in the transfer station T (cartridge bay), into which the cartridge C1 was inserted along the cartridge guide 7. When the image forming apparatus 1 is in the state shown in FIG. 12, the movable core (plunger) 26*a* of the solenoid 26 is in its initial position, and the connecting member 27 is kept pressed in the direction indicated by the arrow mark R' in FIG. 12, by an unshown spring (as pressure applying means).

Figure 13:
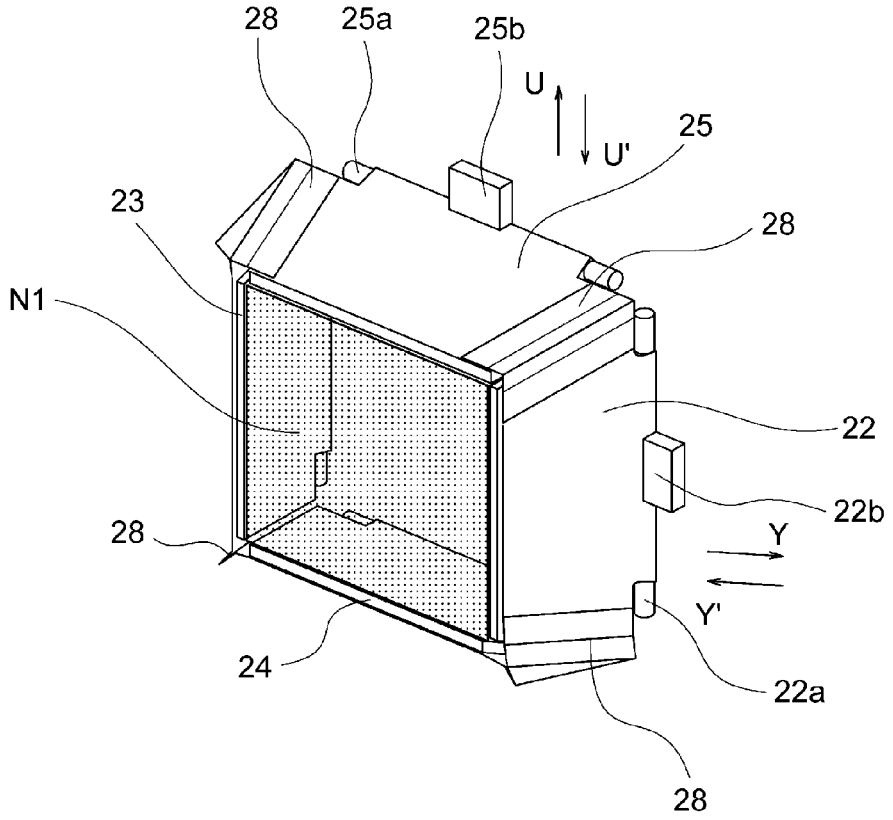
FIG. 13 is a perspective view of the air feeding device in the third embodiment, when the cartridge of the small size is in the cartridge chamber (secondary transfer station), and is for describing the structure of the air feeding device.

Therefore, the contact portions 27*a*-27*d* of the connecting member 27 are in contact with the contact portions 22*b*-25*b* of the airflow adjustment plates 22-25, and press the airflow adjustment plates 22-25 in the directions indicated by arrow marks Y', X', W' and U', respectively. The position in which each of the airflow adjustment plates 22-25 are when the image forming apparatus 1 is in the state shown in FIG. 12, is referred to as the first position. FIG. 13 shows the cross-sectional area N1 of the downstream end of the air duct which the combination of the airflow adjustment plates 22-25 and pieces 28 of film form when the airflow adjustment plates 22-25 are in their first position. When the image forming apparatus 1 is in the state shown in FIG. 12, the velocity V of the airflow at the downstream end (which is N1 in cross-sectional area N1 in FIG. 13) of the air duct is V1.

Figure 14:
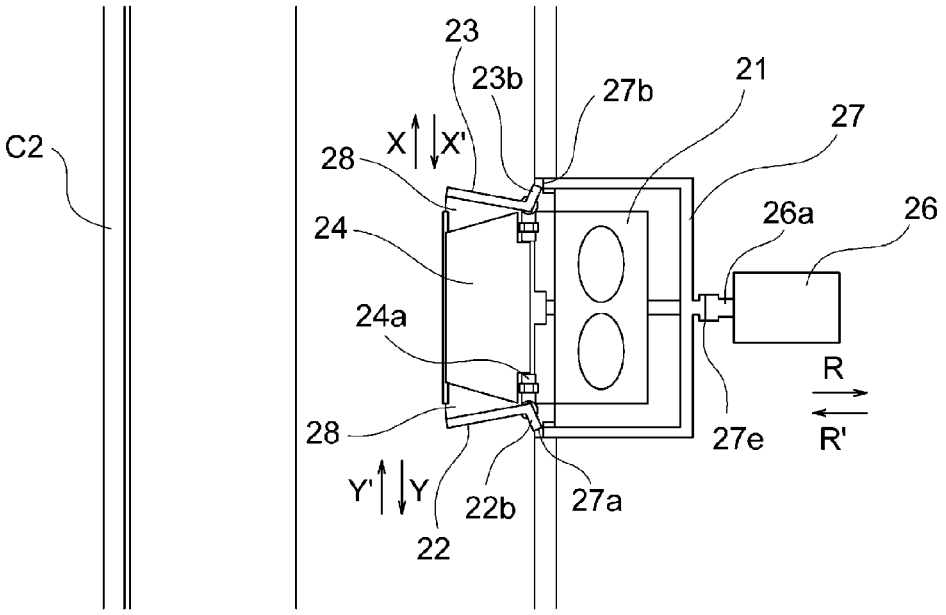
FIG. 14 is a sectional view of the air feeding device in the third embodiment, when the cartridge of the large size is in the cartridge chamber (secondary transfer station), and is for describing the structure of the air feeding device.

FIG. 14 is a sectional view of the portions of the image forming apparatus 1, which are relevant to the present invention, at a plane Z-Z in FIG. 8(*a*), when the cartridge C2, that is, the cartridge of the large size, is in the transfer station T (cartridge bay), into which the cartridge C2 was inserted along the cartridge guide 7. When the image forming apparatus 1 is in the state shown in FIG. 14, the movable core (plunger) 26*a* of the solenoid 26 has been displaced in the direction indicated by an arrow mark R in FIG. 14 by the solenoid 26, which is controlled by the control section 29 based on the information regarding the shape and/or size of the cartridge C2, which was read by the reading portion 8, with which the cartridge contacting lever 20 is provided.

Figure 15:
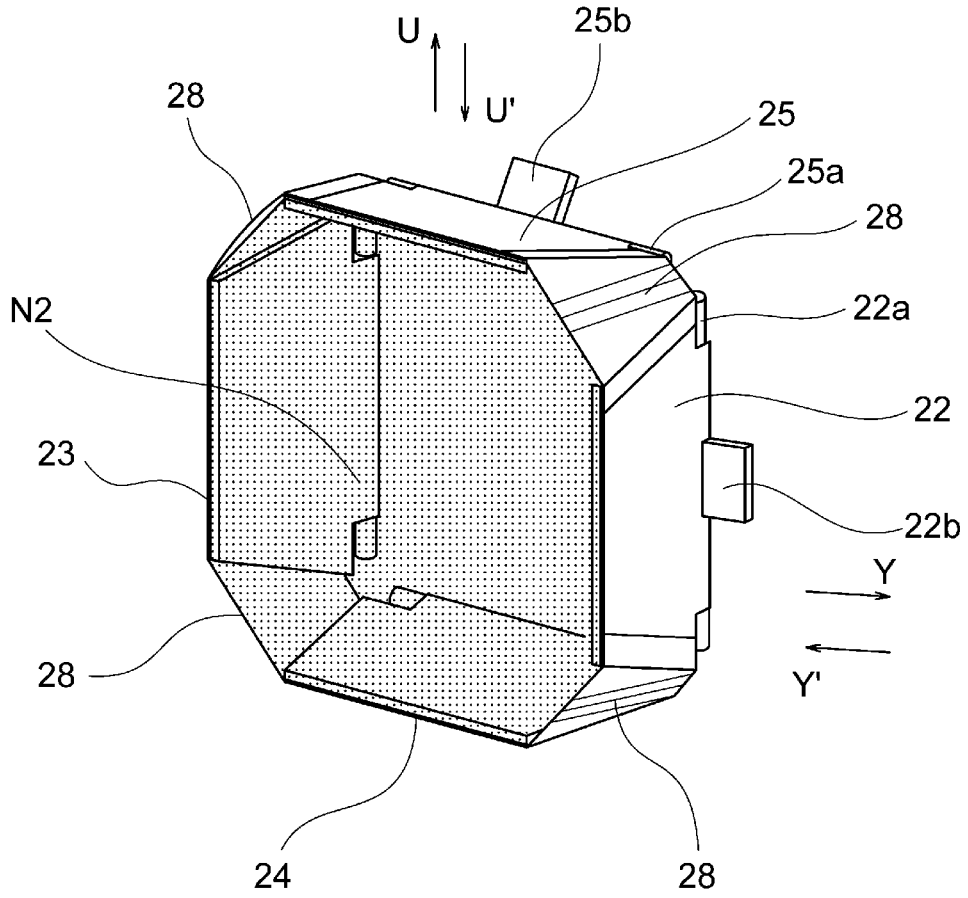
FIG. 15 is a perspective view of the air feeding device in the third embodiment, when the cartridge of the large size is in the cartridge chamber (secondary transfer station), and is for describing the structure of the air feeding device.

That is, the connecting member 27 has been moved in the direction indicated by an arrow mark R in FIG. 14 by the movement of the movable core (plunger) 26*a*, and therefore, the contact portions 27*a*-27*d* of the connecting member 27 were allowed to retreat in the direction indicated by the arrow mark R in FIG. 14. Thus, the airflow adjustment plates 22-25 have been moved in the direction indicated by arrow marks Y', X', W' and U', respectively. The position in which each of the airflow adjustment plates 22-25 is when the image forming apparatus 1 is in the state shown in FIG. 14 is referred to as the second position. FIG. 15 shows the cross-sectional area N2, at the downstream end of the air duct, in terms of the airflow direction, formed by the combination of the airflow adjustment plates 22-25 and pieces 28 of film, when the airflow adjustment plates 22-25 are in their second position shown in FIG. 14. Referring to FIGS. 13 and 14, the relationship, in terms of size, between the cross-sectional areas N1 and N2 is: N2>N1. When the cross-sectional area of the downstream end of the air duct is N2, the velocity V of the airflow at the downstream end of the air duct is V2 (V2<V1).

That is, there is the following relationship between the cross-sectional area N1, shown in FIG. 13, and the cross-sectional area N2, shown in FIG. 15: N1<N2. As for the airflow velocity V, V1>V2. In other words, in a case where air has to be fed to the small cartridge C1, which is greater in the distance from the fan 21 than the large cartridge C2, the airflow velocity becomes V1. Therefore, the airflow can easily reach the small cartridge C1, even though the cartridge C1 is greater in the distance from the fan 21.

Further, as the cartridge C is removed from the image forming apparatus 1, the movable core (plunger) 26*a* of the solenoid is returned to its first position shown in FIG. 12. Thus, the connecting member 27, which is moved by the movement of the movable core (plunger) 26*a* is pressed in the direction indicated by the arrow mark R' in FIG. 12. Thus, the airflow adjustment plates 22-25 are moved in the directions indicated by the arrow marks Y', X', W' and U', in FIGS. 13 and 14.

To sum up this embodiment, as the small cartridge C1 is inserted into the transfer station T (cartridge bay), along the cartridge guide as shown in FIG. 12, the airflow for cooling the small cartridge C1, which is greater in the distance from the fan 21, is increased in velocity V to V1, which is greater than V2 for cooling the large cartridge C2. Referring to FIG. 14, the velocity V2 is for cooling the large cartridge C2 in the transfer station T (cartridge bay), into which the large cartridge C2 was inserted along the cartridge guide 7 as shown in FIG. 14. It is the velocity for the airflow for cooling the large cartridge C2, which is greater in distance from the fan 12 than the small cartridge C1, which is greater in the distance from the fan 21.

As described above, in this embodiment, the airflow generated by the fan 15 is changed in velocity V according to the shape and/or size of the cartridge C in the transfer station T (cartridge bay), into which the cartridge C was inserted along the cartridge guide 7. Thus, the same effects as those obtained in the preceding embodiments can be obtained. That is, as a process cartridge is installed into the image forming apparatus 1, it is properly and efficiently cooled according to the shape and/or size of the cartridge. In other words, this embodiment also can reduce an image forming apparatus in the problem attributable to the excessive increase in cartridge temperature, and therefore, can keep the apparatus excellent in image quality.

Further, the airflow velocity is increased by reducing the downstream end of the air duct in cross-sectional area. Therefore, it is unnecessary to increase the fan 21 in the capacity in terms of air volume. Therefore, this embodiment can reduce an image forming apparatus in the amount of noises, such as a hissing sound, that is characteristic of a fan. That is, this embodiment can make it possible to efficiently cool a small cartridge or the like without increasing the fan 21 in revolution, that is, without increasing an image forming apparatus in the amount of hissing noise. Otherwise, this embodiment is the same in the image forming apparatus structure as the preceding embodiments, and the effects of this embodiment are the same as those of the preceding embodiment.

In this embodiment, the changing device for changing in properties the airflow generated to cool the cartridge C is an electrical communicating means made up of the combination of the memory 19 with which the cartridge C is provided, and the reading portion 8. However, this embodiment is not intended to limit the present invention in terms of the changing device. For example, the changing device may be a mechanical means that controls the control section 29 with the use of the lever 16 (contacting member) which comes into contact with the area of contact of the cartridge C.

Further, it is feasible to use, as necessary, both the changing device in the first embodiment which changes the airflow direction, and the changing device in the second embodiment which changes the fan 21 in revolution.

Further, in the first embodiment, the position into which the airflow adjustment plate 17 is moved, was set by the mechanical changing device which employs the lever (contacting member) 16 which comes into contact with the area of contact of the cartridge C. However, the first embodiment is not intended to limit the present invention in terms of the means for positioning the airflow adjustment plate 17. That is, the means for positioning the airflow adjustment plate 17 may be such that the airflow adjustment plate 17 is changed in attitude (angle) by an unshown driving portion, and the information regarding the shape and/or size of a cartridge, which is in the memory 19, is read, and the driving portion is controlled based on the read information to change the airflow adjustment plate 17 in attitude (angle).

Further, the fans 15 and 21, as airflow generating portions, in the first to third embodiments, were such airflow generating portions that blow air at the cartridge C (air flow generating portions were positioned upstream of cartridge in terms of airflow direction). However, the preceding embodiments are not intended to limit the present invention in terms of the positioning of the airflow generating means. That is, the fan (air feeding device) 15 and 21 may be positioned downstream in terms of the airflow direction so that the ambient air of the cartridge C is drawn by the fans 15 and 21.

Further, in the first to third embodiments, the image forming apparatus 1 is structured so that it can accommodate only a single cartridge per image forming operation. However, these embodiments are not intended to limit the present invention in terms of the number of cartridges installable per image forming operation. That is, an image forming apparatus may be structured so that it can accommodate multiple cartridges C at the same time, and the manner in which air is fed to each cartridge C is adjusted according to the shape and/or size of each cartridge.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 007373/2013 filed Jan. 18, 2013, which is hereby incorporated by reference.

What is claimed is:

1. An image forming apparatus comprising:

a mounting portion to which one of a plurality of kinds of cartridges having different configurations is mountable;

a fan device for cooling the cartridges mounted to said mounting portion with air flow provided thereby; and a changing device for changing a state of the air flow in accordance with the configuration of the cartridge mounted to said mounting portion, wherein said changing device includes a contact member contactable to the cartridge mounted to said mounting portion, and wherein said contact member is displaceable in accordance with a configuration of the mounted cartridge to change the state of air flow.

2. An apparatus according to claim 1, wherein said changing device changes a direction of the air flow in accordance with the configuration of the cartridge mounted to said mounting portion.

3. An apparatus according to claim 2, further comprising an airflow adjustment plate, wherein said changing device displaces said airflow adjustment plate to change the direction of the air flow.

4. An apparatus according to claim 1, wherein said changing device changes a flow speed of the air flow in accordance with a configuration of the cartridge mounted to said mounting portion.

5. An apparatus according to claim 4, further comprising a duct for the air flow, wherein said changing device changes the flow speed by changing an opening area of said duct.

6. An apparatus according to claim 1, wherein said changing device changes a rate of the air flow in accordance with a configuration of the cartridge mounted to said mounting portion.

7. An apparatus according to claim 1, wherein the cartridge contains toner.

8. An apparatus according to claim 7, wherein the cartridges of the different configurations contain different amounts of the toner.

9. A cartridge mountable to an image forming apparatus, said image forming apparatus including a fan device, a contact member, and a changing device for changing a state of an air flow provided by the fan device in accordance with a position of the contact member, said cartridge comprising:

a portion-to-be-contacted contacted by the contact member in a state of being mounted to the image forming apparatus, wherein a position of the contact member is determined by contacting said portion-to-be-contacted.

10. A cartridge according to claim 9, wherein the changing device changes a direction of the air flow.

11. A cartridge according to claim 9, wherein the changing device changes a speed of the air flow.

12. A cartridge according to claim 9, wherein the changing device changes a rate of the air flow.

* * * * *